United States Patent [19]

Csoka

[11] 4,114,892

[45] Sep. 19, 1978

[54] PEG GAME

[75] Inventor: Frank S. Csoka, Sea Cliff, N.Y.

[73] Assignee: Fun Things, Inc., New York, N.Y.

[21] Appl. No.: 765,202

[22] Filed: Feb. 3, 1977

[51] Int. Cl.[2] ..... A63F 9/00

[52] U.S. Cl. ..... 273/265; 273/280; 273/288

[58] Field of Search ..... 273/130 R, 130 B, 1 R, 273/95 R, 136 R, 136 C, 131 AC, 136 E, 130 D, 130 AC, 131 B, 131 BA, 236, 241, 265, 271, 280, 287

[56] References Cited

U.S. PATENT DOCUMENTS

| | | | |
|---|---|---|---|
| 771,943 | 10/1904 | Spicer | 273/95 R |
| 1,168,374 | 1/1916 | Barker | 273/134 GM |
| 1,988,301 | 1/1935 | Coffin | 273/130 D |
| 2,100,421 | 11/1937 | Wupper | 273/136 C |
| 2,293,298 | 8/1942 | MacDonald | 273/130 D |
| 3,632,110 | 1/1972 | Gay | 273/130 D |
| 3,655,191 | 4/1972 | Grant | 273/1 R |

OTHER PUBLICATIONS

Mattel Catalog - 1971; p. 1, "Slip Disc".

*Primary Examiner*—Robert W. Michell
*Assistant Examiner*—Arthur S. Rose
*Attorney, Agent, or Firm*—Marvin Feldman; Stephen Feldman

[57] ABSTRACT

A game is disclosed which is played by two opposing players disposed on opposite sides of a vertically disposed, opaque game board; said board being formed with a plurality of holes therein, and pegs inserted in the holes. Each player rests one U-shaped token member on a peg without disclosing the location of the token member to the other player, and in turn each player removes pegs in an effort to cause the opposing player's token member to drop from the board thereby winning the game. The construction permits the U-shaped token member to fall onto a lower peg disposed directly below the removed peg position, thus frustrating attempts of the opposing player to cause the peg to fall clear of the board. In a preferred embodiment the game is a free standing vertically upright unit.

15 Claims, 4 Drawing Figures

PEG GAME

This invention relates to games. Specifically this invention relates to a peg board game.

Heretofore certain games such as "Battleship" involved opposing players designating and marking a square or position on respective sheets or boards, which square was undisclosed to the other player. And in a series of turns each player sought to ferret out the designated square. That player who first exposed the other player's secreted square was the winner. Such games required markings to be made, and once the markings were made, the secreted square was fixed and could not be changed.

It is now an object of this invention to provide a game wherein a token member is placed on a peg in a secreted position, and the opposing player's position would be revealed in removing the peg and thus exposing the position, without the need for marking sheets of paper.

It is also an object of the invention to provide a game as aforesaid wherein one player could be frustrated or deceived by the opposing player during the course of play without changing the actual position of the secreted member but in changing its relative position to the other pegs.

It is also an object of this invention to provide a game wherein one player in attempting to reveal the hidden member unbeknowingly causes the member to be transferred to another undisclosed position.

It is still another object of this invention to provide a peg board game wherein opposing players in turn remove one peg at a time from the board in an attempt to reveal the other player's secreted member.

It is still another object of this invention to provide a peg board game as aforesaid wherein the rotation of the board permits a realignment of but not change of the actual position of the secreted member on the peg, such realignment being unrevealed to the opposing player.

It is still a further object of this invention to provide a peg board game as aforesaid wherein a secreted token member remains secreted during the course of play and then is exposed by the opposing player in winning the game.

Another object of the invention is to provide a peg board game wherein opposing players in turn remove one peg at a time from the board in an attempt to reveal the other player's secreted member wherein the board game is free standing without a base while permitting peg removal without tilting of the board game.

The aforesaid as well as other objects and advantages of the invention as well appear hereinafter from the following description taken in connection with the accompanying drawings in which.

Figure 1:
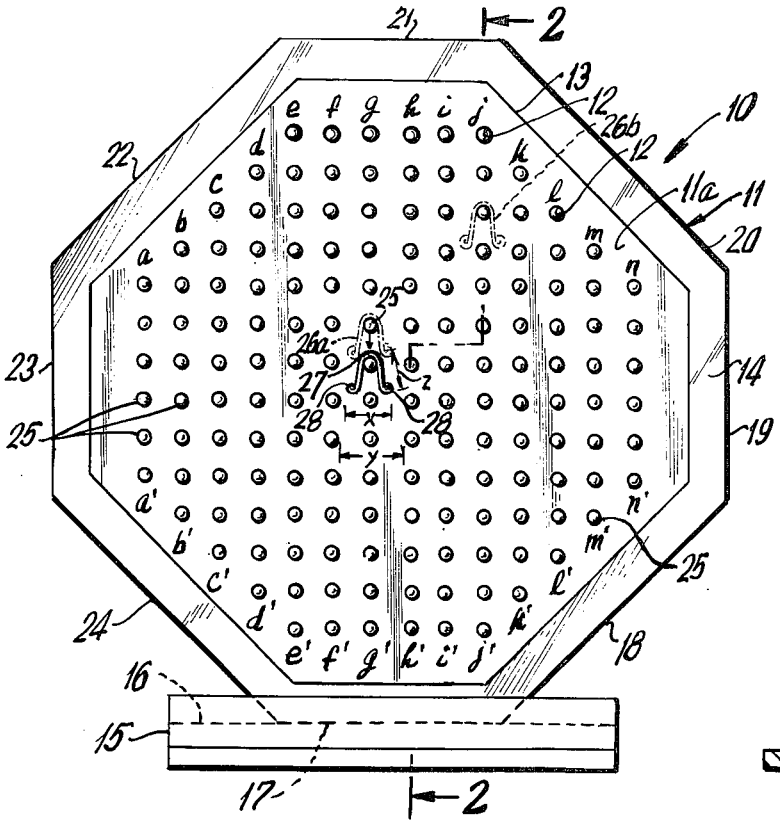
FIG. 1 is an elevational view of one side of the game board at the start of the game.
Figure 2:
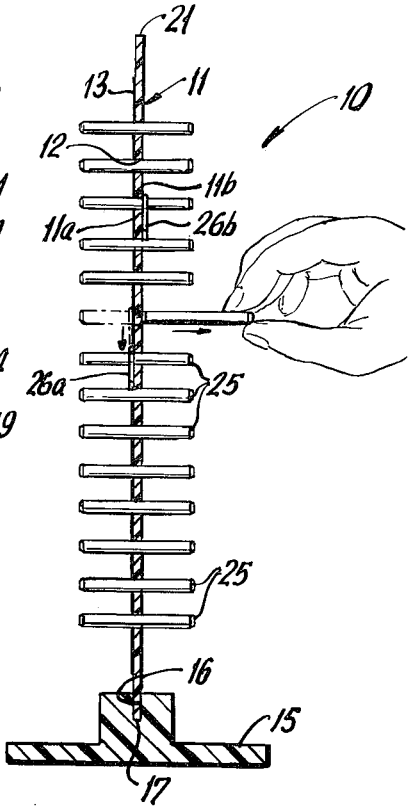
FIG. 2 is a sectional line taken along line 2—2 of FIG. 1.

Referring now to FIGS. 1 and 2, there is shown the peg game of this invention generally designated as numeral 10. Peg game 10 comprises an octagonal plastic game board 11 having identical faces 11*a* and 11*b* on opposite sides and formed with a plurality of equally-sized through-holes 12. Game board 11 is formed with an inner octagonal opaque section 13 and an annular octagonal transluscent or transparent portion 14. A support base 15 is formed with a slot 16 for frictionally receiving each of the octagonal sides 17–24; side 17 being shown in base 15 in FIGS. 1 and 2. Opposing sides 22–18, 24–20, are greater in dimension than opposing sides 21–17 and 23–19.

Holes 12 are arranged within opaque region 13, in 14 parallel rows, said rows being designated *a-a'*, *b-b'*, *c-c'*, *d-d'*, *e-e'*, *f-f'*, *g-g'*, *h-h'*, *g-g'*, *h-h'*, *i-i'*, *j-j'*, *h-h'*, *l-l'*, *m-m'*, and *n-n'*, for purposes of illustration only as will hereinafter appear. Each hole 12 is formed to accommodate peg 25. And at the start of each game all holes 12 are filled with pegs 25 as shown in FIG. 1.

With all the pegs in place, and the respective tokens resting on their undisclosed pegs, the game proceeds with each player in turn removing a peg, other than the peg on which his token resides. In the event a peg is removed on which rests the opposing player's token (see FIG. 2), the opposing player's token will be caused to fall or drop by gravity along the path of its row (e.g., row *g-g'* of FIGS. 1 and 2). In the event there is at least one peg disposed below the withdrawn peg in the same row, then the token will drop onto the next lower peg and reside in a new position; the new position of course also not being disclosed to the player who withdrew the aforesaid peg (FIGS. 1 and 2). In the event, however, there are no pegs in the same row disposed below the withdrawn peg on which the token resided, then of course the token will fall to the bottom and will be revealed through the transluscent portion 14.

After all the holes are filled with pegs, each player takes a token number 26*a* and 26*b*, respectively, and hangs the token member on any desired peg without revealing the token location to the opposing player, and which is undetected because of the presence of the opaque region. The game starts with all pegs inserted and tokens 26*a* and 26*b* in place.

Tokens 26*a* and 26*b* are identical in construction and are formed from a piece of wire which is curved into a peg accommodating portion 27, which portion 27 is U-shaped and tapers outwardly to flanges 28 which are formed by bending the wire into a closed spiral configuration. This token configuration permits the token to rest on the peg. The overall width "*x*" across the flanges 28 must be less than the minimum width "*y*" between alternate peg rows, for reasons hereinafter appearing; and the length "*z*" of each token half-portion should be less than the distance between adjacent pegs, for reasons hereinafter appearing.

The first player to so uncover the opposing player's token is the winner.

Figure 3:
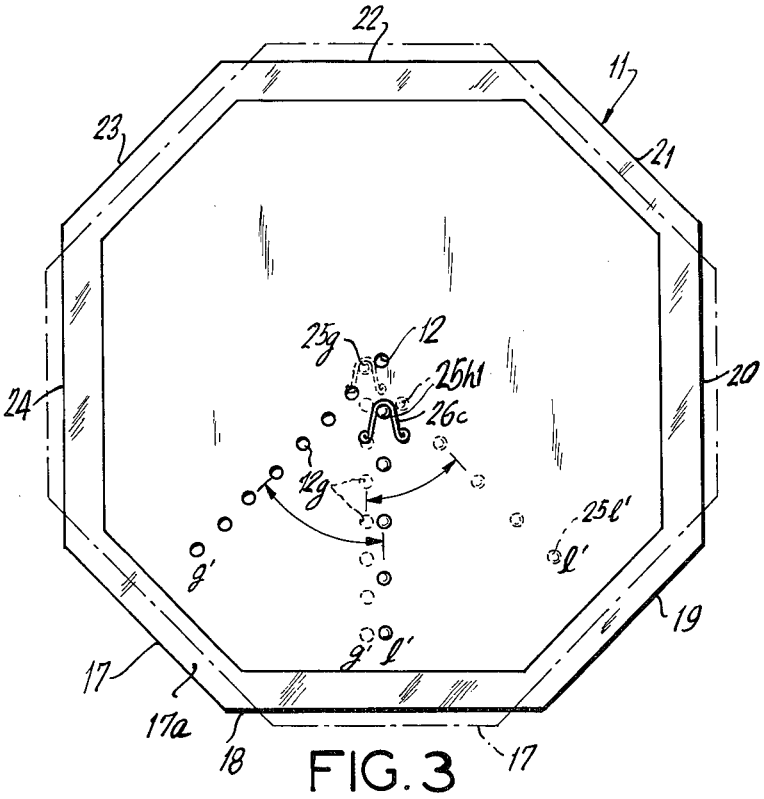
FIG. 3 is an elevational view of one side of the game board during an intermediate stage of play, depicting a board rotation maneuver.

In another aspect of this game as shown in FIG. 3, a player may find that all the pegs disposed below the peg on which the token resides have been removed by the opposing player thus leaving holes 12*g*, and in the event peg 25*g* was to be removed in a subsequent turn, token 26*a* would fall free to clear section 17*a*, thus ending the game. To circumvent this occurrence, the player so endangered may elect in his turn to rotate the board so that another side, other than side 17, rests within the base. For example, the rotation may provide for side 18 to be placed in the base 15. In such a rotation, through the force of gravity, token 26*a* is in sliding rotation with respect to peg 25*g* so that with side 18 in base 15, peg 25*g* is aligned in row *c-l'*. It is to be noted that the row between peg 25g and peg 251' is filled with pegs. It is to be noted that the respective axes of peg 25g, the hole 12g and peg 251' subtend an angle through which the board is rotated, in this rotation maneuver.

Now in the event in a subsequent turn, peg 25g is removed, token 26a will fall onto peg 25hl, thus avoiding the end of the game.

Generally the rules may provide that only one rotation maneuver be permitted in each game, and a rotation maneuver be in lieu of a turn to remove a peg. Modification of the rules are also permissible.

While hole arrangement shown and described in the aforesaid preferred embodiment indicates parallel rows of holes, it is also within the contemplation of this invention to provide radially disposed holes about a central hole such that the token member would tend to fall towards or away from the center of the game board.

It is also within the contemplation of this invention to provide a fixed base on each side of the board so that the rotation maneuver may be made by rotating the board from one base to another.

Figure 4:
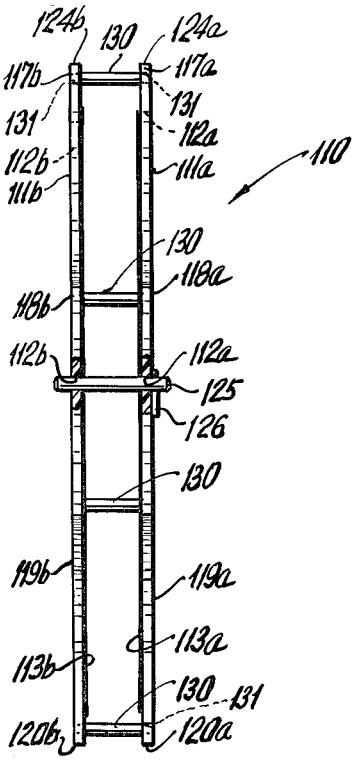
FIG. 4 is a side elevational view of another embodiment of the invention in fragmentary and partial sectional view of two opposing game boards.

Referring now to FIG. 4, there is shown another embodiment of the game generally designated as numeral 110. Game 110 comprises two opposed, similarly-constructed, plastic boards 111a and 111b. Boards 111a and 111b are octagonally-shaped with ends 117a, 118a, 119a, 120a, 121a (not shown), 122a (not shown), 123a (not shown), 124a; and 117b, 118b, 119b, 120b, 121b (not shown), 122b (not shown), 123b (not shown) and 124b, respectively. At the eight corners of each of the octagon boards are holes 131 (typical) for receiving eight equally-sized plastic rods or posts 130 (four being shown in the FIG. 4); said posts being fixedly secured into said holes 131 by glueing, thermoplastic heat sealing or like means. In this manner of construction the boards 111a, 111b, are fixedly spacedly disposed, and each end pair, e.g. 120a and 120b, provide a self-supporting base construction.

The boards 111a, 111b are provided with through holes 112a and 112b, respectively in hole patterns similar to the aforementioned embodiment, so that the spacedly opposed holes of the boards are coaxial pairs. Each elongated peg 125 (only one shown) resides in and may pass freely through each such concentric hole pair, such that U-shaped token members 126 can rest on the peg before the peg is withdrawn. Each board while being of transparent plastic plastic is covered in part with an opaque sheet 113a and 113, respectively, or painted black, or for purposes as described in the embodiment of FIGS. 1–3.

It is also to be noted that the rotation maneuver is readily achievable with this latter described embodiment, insofar as both boards simultaneously may be rotated to rest on different end pairs, such as 119a-119b, 118a-118b, and so forth. Thus it is shown that game 110 is fully operable as game 10 but without the need for a separate support base.

With the present construction, the boards 11, 111a, and 11b are of plastic while the pegs 25 are of wood, but the pegs may be of solid plastic, foamed plastic, felt, and like materials.

It is desirable to provide a peg material which minimizes the impact of the falling token so that the token will fall to rest on the peg and not bounce off. Still further, the token material must provide sliding engagement with the peg.

The token member may be of any suitable material and construction which will drop in a true path onto a lower peg without causing the member to bounce off or slide off, and yet permit sliding rotation of the peg during the rotation maneuver.

Accordingly, while in the foregoing there have been described and shown certain preferred embodiments of the invention, various modifications may become apparent to those skilled in the art to which the invention relates, without departing from the invention as defined in the claims.

What is claimed is:

1. A game comprising, a board, means to support the board in a vertical manner, said board being opaque and being formed with a plurality of holes, a plurality of pegs insertable in said holes so as to extend outwardly on opposite sides of said board, and a member being formed so as to rest on a peg inserted in one hole, at one side of the board, and not visible from the other side, said member being formed with a central portion to be disposed on the peg, and flange portions joined to the central portion and having flange ends extending away from the central portion, so that the ends are spaced from each other, and being dimensioned to permit free fall of the member and said member being so dimensioned and the spacing between said holes being so dimensioned such that when said holes have pegs therein with the central portion of said member disposed on one of said pegs, said member is freely rotatable and whereby the withdrawal of the peg with the member thereon from the other side of the board causes the member to fall from the withdrawn peg, and wherein the holes are disposed in a row so that one hole is disposed below another, and wherein another inserted peg is disposed below the aforesaid inserted peg with member so that upon removal of the first said peg, the member drops freely unto the second peg so that the central portion is then disposed on said second peg.

2. The game of claim 1, wherein the central portion and flange portions form a tapered U-shape.

3. The game of claim 1, said member being rotatably disposed on said first peg, and another hole in said board for inserting a third peg therein, so that the three holes for inserting said three pegs subtend an angle with the first hole as the apex, so that with rotation of said board through said angle the member rotates on the first peg so as to be disposed above the third peg.

4. The game of claim 3, wherein the board is a polygon having more than four sides, and said means to support the board supports the board on at least two adjacent sides of the polygon, and wherein the holes are arranged so as to provide parallel vertical rows of holes at each of the two supported side positions, so that there are at least three holes subtending an angle as aforesaid at each of the two supported side positions.

5. The game of claim 4, said means to support the board comprising a base being formed with means to receive each of said two adjacent sides.

6. The game of claim 1, said means to support said board comprising a base transversely disposed to said board.

7. The game of claim 1, said flange portions being weighted so that the member falls onto the next below peg.

8. The game of claim 1, further comprising a clear portion disposed below the opaque portion, so that the member when falling below the opaque portion is viewable through the clear portion.

9. The game of claim 1, further comprising a second member to rest on a second peg at the other side of the board.

10. The game of claim 1, wherein the board is polygonal, and wherein the holes are in parallel rows with less holes in a row the more adjacent a row is to one of the sides of the board.

11. A game comprising a pair of boards, means to hold said boards in spacedly disposed relationship, each of said boards being formed with a like plurality of holes wherein coaxial hole pairs are provided, a plurality of pegs insertable in said hole pairs so as to extend outwardly on opposite sides of said board, and a member being formed so as to rest on an inserted peg at one side of one board, said member being formed with a central portion to be disposed on the peg, and flange portions joined to the central portion and having flange ends extending away from the central portion so that the ends are spaced from each other, and being dimensioned to permit free fall of the member and the spacing between said holes being so dimensioned such that when said holes have pegs therein with the central portion of said member disposed on one of said pegs, said member is freely rotatable and whereby withdrawal of the peg with the member from the oppositely disposed side of the other board causes the member to fall from the withdrawn peg and wherein the hole pairs are disposed in a row so that one hole is disposed below another, and wherein another inserted peg is disposed below the aforesaid inserted peg, with member so that upon removal of the first said peg, the member drops freely unto the second peg so that the central portion is then disposed on said second peg.

12. The game of claim 11, each of said boards being a polygon of more than four sides and each board having the same number of sides, wherein opposed board end pairs support the boards in an upright manner.

13. The game of claim 12, said means to hold said boards comprising post means disposed between the boards, and means to fixedly join said post means to said boards.

14. The game of claim 13, means to provide an opaque region between said boards.

15. The game of claim 12, said member being rotatably disposed on said first peg, and another hole pair on said board for inserting a third peg therein, so that the three hole pairs for inserting said three pegs subtend an angle with the first hole pair as the apex so that with rotation of said board through said angle the member rotates on the first peg to be removed.

* * * * *